US005514517A

United States Patent [19]

Waki

[11] Patent Number: 5,514,517

[45] Date of Patent: May 7, 1996

[54] PROCESS FOR IMAGE FORMATION BY SILVER SALT DIFFUSION TRANSFER

[75] Inventor: Koukichi Waki, Kanagawa, Japan

[73] Assignee: Fuji Photo Film Co., Ltd., Kanagawa, Japan

[21] Appl. No.: 370,638

[22] Filed: Jan. 10, 1995

[30] Foreign Application Priority Data

Jan. 12, 1994 [JP] Japan ..... 6-001768

[51] Int. Cl.[6] ..... G03C 8/06; G03C 8/32; G03C 8/42

[52] U.S. Cl. ..... 430/244; 430/207; 430/230; 430/567

[58] Field of Search ..... 430/230, 244, 430/207, 249, 567

[56] References Cited

U.S. PATENT DOCUMENTS

| | | | |
|---|---|---|---|
| 2,603,565 | 7/1952 | Land | 430/249 |
| 3,293,034 | 12/1966 | Green et al. | 96/29 |
| 4,654,297 | 3/1987 | Inoue | 430/230 |
| 4,659,646 | 4/1987 | Inoue | 430/230 |
| 4,797,354 | 1/1989 | Saitou et al. | 430/567 |
| 5,206,115 | 4/1993 | Waki | 430/230 |
| 5,286,622 | 2/1994 | Waki | 430/567 |

FOREIGN PATENT DOCUMENTS

| | | | |
|---|---|---|---|
| 2146039 | 6/1990 | Japan . | |
| 788424 | 1/1958 | United Kingdom | 430/244 |

*Primary Examiner*—Richard L. Schilling

*Attorney, Agent, or Firm*—Sughrue, Mion, Zinn, Macpeak & Seas

[57] ABSTRACT

A process for image formation by silver salt diffusion transfer which comprises developing an imagewise exposed photosensitive element containing a photosensitive silver halide emulsion layer with an alkaline processing element containing a silver halide solvent to thereby convert at least part of the silver halide present in the unexposed area of the emulsion layer into a transferable silver complex and then transferring at least part of the silver complex to an image-receiving element containing an image-receiving layer containing silver-precipitating nuclei to thereby form an image on the image-receiving element, said silver halide emulsion contained in the silver halide emulsion layer in the photosensitive element being a tabular grain emulsion which is obtained by chemically sensitizing tabular silver halide grains and depositing a silver iodobromide having a silver iodide content of from 2 to 15 mol % on the surface of the resulting grains in an amount of from 3 to 20 mol % and which has a total average silver iodide content of from 0.5 to 3.5 mol % and an average aspect ratio of from 2 to 20, and said photosensitive element, image-receiving element, and processing element satisfying the relationship shown by the following equation (1):

$$(Ts+Tr)\times 5 \leqq D \leqq (Ts+Tr)\times 5+20 \quad (1)$$

wherein Ts (μm) is the thickness of the photosensitive element on the silver halide emulsion layer side, excluding a support, Tr (μm) is the thickness of the silver-precipitating-nuclei-containing image-receiving layer in the image-receiving element, and D (μm) is the thickness of the spread liquid of the processing element.

11 Claims, No Drawings

PROCESS FOR IMAGE FORMATION BY SILVER SALT DIFFUSION TRANSFER

FIELD OF THE INVENTION

The present invention relates to a process for image formation by silver salt diffusion transfer, more particularly, a process by which an image can be completed rapidly with high sensitivity.

BACKGROUND OF THE INVENTION

The diffusion transfer process is well known in the art, and details thereof are hence omitted here. The transfer process is described in detail, for example, in A. Rott and E. Weyde, "Photographic Silver Halide Diffusion Processes", Focal Press (1972); J. Sturge, V. Walworth and A. Shepp, "Imaging Processes and Materials: Neblette's Eighth Edition", Van Nostrand Reinhold (1989), Chapter 6, "Instant Photography and Related Reprographic Processes"; and G. Haist, "Modern Photographic Processing Vol.2", John Wiley and Sons (1979), Chapter 8, "Diffusion Transfer". As described in detail in these references, many kinds of photographic materials can be produced by this diffusion transfer process. For example, it is known that a transferred image can be obtained by spreading a processing element comprising a highly viscous alkaline processing composition containing a developing agent and a silver halide solvent between superposed two elements, i.e., a photosensitive element comprising a support having coated thereon a silver halide emulsion and an image-receiving element comprising another support having provided thereon an image-receiving layer containing silver-precipitating nuclei.

In the above constitution, the photosensitive element is exposed to light and then superposed on the image-receiving element, with the processing element being spread therebetween. After a certain time period, the photosensitive and image-receiving elements are stripped apart to obtain a transferred image on the image-receiving element. Completing such a transferred image more rapidly is always desired.

Methods for accelerating the completion of a transferred image include a technique of using a highly reducing substance, e.g., hydroquinone or a derivative thereof, for the developing agent contained in the processing element and further using a substance which brings about a high dissolution rate, e.g., hypo, for the silver halide solvent; and a technique of changing the silver halide emulsion in the photosensitive element into an emulsion based on a silver halide having higher solubility, e.g., silver chloride or silver chlorobromide. However, the former technique is defective in that the transferred image is so instable that long-term storage thereof is impossible. This is mainly because oxidation products formed from the developing agent cause staining and the residual hypo causes sulfurization. For preventing such deterioration, it is necessary to coat the image surface with a layer of an antioxidant substance, e.g., poly(vinyl alcohol) containing an alkali neutralizer, immediately after image completion, resulting in complicated handling. The latter technique is defective in that it is unusable for photographing because of too low sensitivity, and that the transferred image has a low density since fogging tends to occur.

SUMMARY OF THE INVENTION

An object of the present invention is to provide a process for image formation by which process a transferred image is completed rapidly with high sensitivity even at various ambient temperatures.

The above object is accomplished with a process for image formation by silver salt diffusion transfer which comprises developing an imagewise exposed photosensitive element containing a photosensitive silver halide emulsion layer with an alkaline processing element containing a silver halide solvent to thereby convert at least part of the silver halide present in the unexposed area of the emulsion layer into a transferable silver complex and then transferring at least part of the silver complex to an image-receiving element containing an image-receiving layer containing silver-precipitating nuclei to thereby form an image on the image-receiving element, said silver halide emulsion contained in the silver halide emulsion layer in the photosensitive element being a tabular grain emulsion which is obtained by chemically sensitizing tabular silver halide grains and depositing a silver iodobromide (having a silver iodide content of from 2 to 15 mol %) on the surface of the resulting grains in an amount of from 3 to 20 mol % and which has a total average silver iodide content of from 0.5 to 3.5 mol % and an average aspect ratio (diameter of the projected area/grain thickness) of from 2 to 20, and said photosensitive element, image-receiving element, and processing element satisfying the relationship shown by the following equation (1):

$$(Ts+Tr)\times 5 \leqq D < (Ts+Tr)\times 5+20\ \mu m \quad (1)$$

wherein Ts (μm) is the thickness of the photosensitive element on the silver halide emulsion layer side, excluding a support, Tr (μm) is the thickness of the silver-precipitating-nuclei-containing image-receiving layer in the image-receiving element, and D (μm) is the thickness of the spread liquid of the processing element.

DETAILED DESCRIPTION OF THE INVENTION

The emulsion grains used in the present invention are grains of a silver iodobromide or a silver chloroiodobromide.

Before chemical sensitization, the tubular grain emulsion for use in this invention may have either a homogeneous structure or a core/shell structure, but it preferably has a core/shell structure. In the case of a core/shell structure, the shell may have a single layer or two or more layers. Although the core/shell structure may have any halogen composition, it preferably has a region which differs from the other resin in silver iodide content. Specifically, a core/shell structure having a layer which has a silver iodide content of 30 mol % or higher and which has been formed during grain formation is preferred from the standpoint of attaining higher sensitivity. Such a layer may be formed, for example, by adding silver nitrate and potassium iodide or by adding potassium iodide alone. Even in the method in which potassium iodide alone is added, a silver iodobromide forms by recrystallization. It is generally known that the maximum silver iodide content in a mixed silver iodobromide crystal is about 40 mol %.

The proportion of the cores to the shells may be freely selected, but it is preferably from 80:20 to 20:80 by mol.

The silver halide emulsion grains for use in this invention as a whole have an average silver iodide content of from 0.5 to 3.5 mol %, preferably from 1.0 to 3.5 mol %, more preferably from 1.5 to 3.0 mol %. The silver chloride content in the grains is not particularly limited, but it is preferably 1 mol % or lower from the standpoints of sensitivity and fogging.

For the cores of the emulsion grains for use in the present invention, a lower silver iodide content is effective in narrowing the grain size distribution and enabling the emulsion grains to be highly sensitive and rapidly transferable. In the present invention, the silver iodide content in the cores is preferably 1 mol % or lower, more preferably zero.

The silver iodobromide deposited after chemical sensitization on the grain surface is exceedingly effective in attaining higher sensitivity without lowering the dissolution rate. The amount of the silver iodobromide deposited, in this invention, is from 3 to 20 mol %, preferably from 3 to 15 mol %, based on the amount of the host grains. Too small or too large silver iodobromide amounts outside the above range result in reduced sensitivity and cannot bring about the effect. The silver iodobromide deposited on the grain surface has a silver iodide content of from 2 to 15 mol %, preferably from 3 to 10 mol %. Too high silver iodide contents result in reduced dissolution rates and retarded completion of a transferred image. On the other hand, too low silver iodide contents result in reduced sensitivity. For depositing a silver iodobromide, use may be made, for example, of a method in which silver ions and halogen ions are added after chemical sensitization, a method in which a fine silver iodobromide grain emulsion is added and the silver iodobromide is recrystallized on the host grains by Ostwald ripening, or a method in which a fine silver bromide grain emulsion and an aqueous potassium iodide solution are added and a silver iodobromide is recrystallized on the host grains by Ostwald ripening.

In the present invention, the processing element should be spread at a thickness which meets the following equation (1).

$$(Ts+Tr)\times 5 \leqq D < (Ts+Tr)\times 5+20\ \mu m \quad (1)$$

In equation (1), Ts (μm) is the total thickness of the silver halide emulsion layer, a protective layer, and any other layers. The total thickness of these layers is preferably from 0.5 to 8.0 μm, more preferably from 1.0 to 6.0 μm. Tr (μm) is the thickness of the layer containing silver-precipitating nuclei. This silver-precipitating-nuclei-containing layer is mostly a hydrophilic layer comprising a regenerated cellulose, but is not partially hydrophilic. In either case, Tr is the thickness of the whole layer containing silver-precipitating nuclei, and is preferably from 0.2 to 6 μm, more preferably from 0.5 to 4 μm. D (μm) is the thickness of the spread liquid of the processing element, and is in the range determined by calculation using equation (1) given above. In the case where Ts and Tr each is minimum, D is from 3.5 to 23.5 μm. Where Ts and Tr each is maximum, D is from 70 to 90 μm.

The silver halide grains according to the present invention may be either grains in which a latent image is formed primarily on the surface thereof or grains in which a latent image is formed primarily in the inside thereof, or grains in which a latent image is not localized in any of them. In particular, grains in which the latent image is formed at a position at which the maximum sensitivity is exhibited under the following condition are preferred: a latent image position confirming condition—a sample comprising a silver halide emulsion coated on a polyethylene terephthalate film in the amount of 1 g/m$^2$ as silver and a gelatin protective layer provided thereon is exposed and then developed in a processing solution of MAA-1 (i.e., abbreviation for metal ascorbic acid developer)+hypo 0.3 g/l at 20° C. for 20 minutes.

The tabular grains of the present invention are not particularly limited in the diameter of circle corresponding to the projected area thereof, but the diameter of the corresponding circle is preferably from 0.5 to 10 μm, more preferably from 0.5 to 8 μm, particularly preferably from 0.5 to 6 μm. The aspect ratio of the tabular grains for use in this invention is from 2 to 20, preferably from 2 to 15, more preferably from 3 to 10. The tabular grains may have either a narrow or a broad grain size distribution. However, a narrow grain size distribution is preferred, and the degree of monodispersion thereof is preferably 20% or lower in terms of coefficient of variation (standard deviation/average diameter of corresponding circle).

In the case where monodisperse grains are used for a silver halide emulsion, two or more kinds of monodisperse grains may be used in admixture. This enables easier gradation design than in the case of using polydisperse grains, and gives a preferred gradation.

The emulsion for use in the present invention can be prepared by any of the methods described, for example, in P. Glafkides, "Chimie et Phisique Photographique", Paul Montel (1967); G. F. Duffin, "Photographic Emulsion Chemistry", Focal Press (1966); and V. L. Zelikman et al., "Making and Coating Photographic Emulsions", Focal Press (1964). Namely, any of the acid process, neutral process, and ammonia process and the like may be used, and the reaction of a soluble silver salt and a soluble halogen salt may be carried out by any of the single-jet method, the double-jet method, a combination of these, and the like. It is possible to use a method in which grains are formed in an atmosphere containing excess silver ions (so-called reverse mixing method). Also usable is one form of the double-jet method, in which the pAg in the liquid phase where a silver halide generates is kept constant (i.e., the controlled double-jet method). By this method, a nearly monodisperse silver halide emulsion having regularity in crystal form can be obtained. Another utilizable method for obtaining a nearly monodisperse tabular silver halide is described, e.g., in U.S. Pat. No. 4,797,354.

Into the silver halide emulsion for use in this invention, various compounds of polyvalent metal ions may be incorporated during emulsion grain formation or physical ripening. Examples of such compounds include salts of cadmium, zinc, lead, and thallium and salts or complexes of Group VIII elements of the periodic table such as iron, iridium, ruthenium, rhodium, palladium, osmium, and platinum. Such compounds of Group VIII elements are especially preferred. The addition amount of these compounds vary widely depending on purposes, but is preferably from $10^{-9}$ to $10^{-4}$ mol per mol of the silver halide.

For the chemical sensitization of the silver halide emulsion of the present invention, use may be made of any of the methods described in the aforementioned books written by Glafkides, Duffin, and Zelikman et al., respectively, or the method described in H. Frieser, "Die Grundlagen der Photographischen Prozesse mit Silberhalogeniden" (Akademische Verlagsgesellschaft (1968).

Specific examples of such chemical sensitization methods include the sulfur sensitization method which uses an active gelatin or a compound each having a sulfur atom reactive with silver (e.g., a thiosulfuric acid salt, a thiosulfonic acid salt, thiourea or a derivative thereof, a mercapto compound, or rhodanine or a derivative thereof); the selenium sensitization method using a selenium compound, as described, e.g., in U.S. Pat. No. 5,236,821; the tellurium sensitization method using a tellurium compound, as described, e.g., in International Patent 93/12475; the noble metal sensitization method using a noble metal compound (e.g., a gold complex or a complex of a Group VIII metal of the periodic table such as platinum, iridium, or palladium); and the reduction sensitization method using a reducing substance (e.g., a stannous salt, an amine, a hydrazine derivative, formamidinesulfinic acid, or a silane compound). These methods may be used alone or in combination.

Each of these compounds may be added in any amount in the range of from 2.∴10–8 to $5\times10^{-4}$ mol per mol of the silver halide.

Spectral sensitizers preferably used for the silver halide emulsion of the present invention include cyanine dyes, merocyanine dyes, composite cyanine dyes, composite merocyanine dyes, holopolar cyanine dyed, hemicyanine dyes, styryl dyes, and hemioxonol dyes. Particularly useful are cyanine dyes, merocyanine dyes, and composite merocyanine dyes. Specific examples thereof are given in F. M. Hamer, "Heterocyclic Compounds-Cyanine Dyes and Related Compounds", John Wiley and Sons (1964). Other usable spectral sensitizers are given, e.g., in U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Patents 1,195,302, 1,242,588, and 1,293,862, West German Patent Applications (OLS) Nos. 2,030,326 and 2,121,780, JP-B-43-4936, JP-B-44-14030, JP-B-43-10773, U.S. Pat. Nos. 3,511,664, 3,522,052, 3,527,641, 3,615,613, 3,615,632, 3,617,295, 3,635,721, and 3,694,217, and British Patents 1,137,580 and 1,216,203. (The term "JP-B" as used herein means an "examined Japanese patent publication.")

A combination of two or more spectral sensitizers may be used as described in JP-A-59-114533 and JP-A-61-163334. (The term "JP-A" as used herein means an "unexamined published Japanese patent application.")

A preferred layer constitution of the photosensitive element of the present invention is produced by using a support which comprises a poly(ethylene terephthalate) film containing titanium dioxide or carbon black and has a subbing layer on each side, forming on one side of the support a photosensitive silver halide emulsion layer and a protective layer thereon, and further forming on the other side of the support a carbon black layer and a protective layer thereon. Also preferred is a constitution having three or more layers on the silver halide emulsion layer side which constitution is produced, for example, by further forming any desired layer between the support and the silver halide emulsion layer or between the silver halide emulsion layer and the protective layer or forming two or more silver halide emulsion layers.

Still another preferred constitution of the photosensitive element besides the constitutions described above is produced by using a support which comprises a poly(ethylene terephthalate) film containing titanium dioxide or carbon black and has a subbing layer on each side, forming on one side of the support a titanium dioxide layer, a photosensitive silver halide emulsion layer thereon, and a protective layer thereon, and further forming on the other side of the support a carbon black layer and a protective layer thereon. A colored dye may be used in place of or in addition to the carbon black. In the case of using poly(ethylene terephthalate) containing carbon black and/or a colored dye, the layer of carbon black and/or a colored dye may be omitted on one side. The titanium dioxide may be replaced with another white pigment.

Besides the aforementioned polyester compound, examples of the support for the photosensitive element include polyethylene-laminated paper, baryta paper, and cellulose triacetate.

The amount of silver halide grains contained in the silver halide emulsion layer in the photosensitive element of this invention is from 0.1 to 3.0 g/m$^2$, preferably from 0.2 to 2.0 g/m$^2$, more preferably from 0.2 to 1.0 g/m$^2$, in terms of the amount of silver.

In order to enhance the effects of the present invention, various compounds may be incorporated into the photosensitive silver halide emulsion layer for the purpose of preventing fogging during the production or storage of the photographic material or during photographic processing or of stabilizing photographic performances.

Preferred examples of these compounds include well known antifoggants and stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles, and benzotriazoles), mercaptopyrimidines, mercaptotriazines, thioketo compounds, azaindenes (e.g., triazaindenes, tetrazaindenes, pentazaindenes), benzenesulfonic acid, benzenesulfinic acid, benzenesulfonamide, α-lipoic acid, and derivatives of these compounds. Representative examples thereof include 1-phenyl-2-mercaptotetrazole, 4-hydroxy- 6-methyl-1,3,3a,7-tetrazaindene, 2-mercaptobenzothiazole, and 5-carboxybutyl-1,2-dithiolan.

More specific examples of the above compounds are given, e.g., in U.S. Pat. No. 3,982,947 and JP-B-52-28660, and these compounds may be used by the methods described therein.

An inorganic or organic hardener may be incorporated into the photosensitive element of the present invention. Examples thereof include chromium salts (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine), and mucohalogenic acids (e.g., mucochloric acid and mucophenoxychloric acid). These hardeners may be used alone or in combination.

A coating aid may be used for the silver halide emulsion layer and other hydrophilic colloid layers in the photosensitive element of the present invention. Examples of the coating aid include the compounds given in "Research Disclosure", Vol. 176, 17643, p.26 (published in Dec., 1978) under "Coating Aids" and the compounds given in JP-A-61-20035.

The silver halide emulsion layer and other hydrophilic colloid layers in the photosensitive element of the present invention may contain a compound which functions to enhance sensitivity or contrast or accelerate development. Examples of such a compound include polyalkylene oxides and derivatives thereof such as ethers, esters, and amines, thioether compounds, thiomorpholine and derivatives thereof, quaternary ammonium salts, urethane derivatives, urea derivatives, imidazole derivatives, and 3-pyrazolidone and derivatives thereof. Specific examples of such compounds usable in this invention are given, e.g., in U.S. Pat. Nos. 2,400,532, 2,423,549, 2,716,062, 3,617,280, 3,772,021, and 3,808,003.

A dispersion of a water-insoluble or sparingly water-soluble synthetic polymer may be incorporated into the silver halide emulsion layer and other hydrophilic colloid layers in the photosensitive element of this invention in order to improve dimensional stability. For example, the synthetic polymer may be a homopolymer of an alkyl (meth)acrylate, an alkoxyalkyl (meth)acrylate, glycidyl (meth)acrylamide, a vinyl ester (e.g., vinyl acetate), acrylonitrile, an olefin, styrene, or the like, a copolymer of two or more of these monomers, or a copolymer of any of these monomers with acrylic acid, methacrylic acid, an α,β-unsaturated dicarboxylic acid, a hydroxyalkyl (meth)acrylate, styrenesulfonic acid, or the like.

The protective layer on the silver halide emulsion layer comprises a hydrophilic polymer, e.g., gelatin. This protective layer may contain a matting agent or a slip agent, e.g., a poly(methyl methacrylate) latex or silica, such as those described in JP-A-61-47946 and JP-A-61-75338.

A dye or an ultraviolet absorber may be incorporated into the silver halide emulsion layer and other hydrophilic colloid layers in the photosensitive element of the present invention for the purpose of providing a filter effect or of preventing irradiation.

Besides the additives described above, an antistatic agent, a plasticizer, and an aerial fog inhibitor may be incorporated into the photosensitive element of the present invention.

A gelatin is advantageously used as the hydrophilic binder for the photosensitive element of this invention. However, other hydrophilic binders are also usable. Examples thereof include proteins (e.g., gelatin derivatives, graft polymers of gelatin with other polymers, albumin, and casein), cellulose derivatives (e.g., hydroxyethyl cellulose, carboxymethyl cellulose, and cellulose sulfates), saccharides (e.g., sodium alginate and starch derivatives), and synthetic hydrophilic polymers (e.g., poly(vinyl alcohol), a partially acetalized poly(vinyl alcohol), poly(N-vinylpyrrolidone), polyacrylamide, polyvinylimidazole, polyvinylpyrazole, and copolymers thereof).

The gelatin may be a lime-processed gelatin, an acid-processed gelatin, or an enzyme-processed gelatin such as that described in Bull. Soc. Sci. Phot. Japan, No.16, p.30 (1966). Also usable are hydrolyzates of gelatins and products of enzymatic decomposition of gelatins.

Examples of the gelatin derivatives include products of the reaction of a gelatin with an acid halide, an acid anhydride, an isocyanate, bromoacetic acid, an alkanesultone, a vinylsulfonamide, a maleinimide compound, a polyalkylene oxide, an epoxy compound, or the like. Specific examples of such gelatin derivatives are given, e.g., in U.S. Pat. Nos. 2,614,928, 3,132,945, 3,186,846, and 3,312,553, British Patents 861,414, 1,033,189, and 1,005,784, and JP-B-42-26845.

The gelatin graft polymer may be one comprising a gelatin and, grafted thereto, a homopolymer or copolymer of one or more vinyl monomers such as acrylic acid, methacrylic acid, acrylic esters, acrylamide, acrylonitrile, and styrene. Examples of this graft polymer are given, e.g., in U.S. Pat. Nos. 2,763,625, 2,831,767, and 2,956,884.

The image-receiving element for use in the present invention comprises a support and supported thereon an image-receiving layer containing silver-precipitating nuclei. Examples of the support include baryta paper, polyethylene-laminated paper, and a film of cellulose triacetate or a polyester compound. Such an image-receiving element may be produced preferably by coating a support which may have a subbing layer with a coating solution comprising silver-precipitating nuclei dispersed in an appropriate cellulose ester solution, e.g., in a cellulose diacetate solution. The cellulose ester layer obtained is hydrolyzed with an alkali to convert the cellulose ester into cellulose at least partly along the depth direction. In an especially useful embodiment of the image-receiving element, the silver-precipitating nucleus layer and/or the lower cellulose ester layer which has not undergone hydrolysis, i.e., the unhydrolyzed part of the cellulose ester layer containing, e.g., cellulose diacetate, contains one or more mercapto compounds suitable for improving the tone or stability of transferred silver images or other photographic performances. Such a mercapto compound diffuses from its original position during imbibition to perform its function. This type of image-receiving element is disclosed in U.S. Pat. No. 3,711,283.

Preferred examples of the above mercapto compound include the mercapto compounds given in JP-A-49-120634, JP-B- 56-44418, British Patent 1,276,961, JP-B-56-21140, JP-A-59- 231537, and JP-A-60-122939.

Examples of the silver-precipitating nuclei include heavy metals, e.g., iron, lead, zinc, nickel, cadmium, tin, chromium, copper, and cobalt, and noble metals, e.g., gold, silver, platinum, and palladium. Other useful silver-precipitating nuclei include sulfides and selenides of heavy metals and noble metals, in particular, mercury, copper, aluminum, zinc, cadmium, cobalt,. nickel, silver, lead, antimony, bismuth, cerium, magnesium, gold, platinum, and palladium. Particularly preferred are gold, platinum, palladium, and sulfides of these.

An acidic polymer for neutralization (alkali neutralization layer) is preferably formed between the unsaponified layer (timing layer) and the support. For example, the polymeric acids described, e.g., in U.S. Pat. No. 3,594,164 may be used. Preferred polymeric acids include maleic anhydride copolymers (e.g., styrene-maleic anhydride copolymers, methyl vinyl ether-maleic anhydride copolymers, and ethylene-maleic anhydride copolymers) and (meth)acrylic acid (co)polymers (e.g., acrylic acid-alkyl acrylate copolymers, acrylic acid-alkyl methacrylate copolymers, methacrylic acid-alkyl acrylate copolymers, and methacrylic acid-alkyl methacrylate copolymers).

Besides the above polymeric acids, polymers containing a sulfonic acid are also useful such as polyethylenesulfonic acid and a product of the acetalization of poly(vinyl alcohol) with benzaldehydesulfonic acid.

The neutralization layer may contain the same mercapto compound as the timing layer. For the purpose of improving the physical properties of the film, those polymeric acids may be used in admixture with an alkali-impermeable hydrolyzable polymer (particularly preferably the cellulose ester mentioned above) or with an alkali-permeable polymer.

The image-receiving element preferably contains an image-stabilizing layer for improving the storage life of images. A cationic polymeric electrolyte is preferred as the stabilizer for this image-stabilizing layer. Particularly preferred cationic polymeric electrolytes are the aqueous dispersion latexes described in JP-A-59-166940, U.S. Pat. No. 3,958,995, JP-A-55-142339, JP-A-54-126027, JP-A-54-155835, and JP-A-53-30328, the poly(vinylpyridinium salt)s given in U.S. Pat. Nos. 2,548,564, 3,148,061, and 3,756,814, the water-soluble quaternary ammonium salt polymer given in U.S. Pat. No. 3,709,690, and the water-insoluble quaternary ammonium salt polymer given in U.S. Patent 3,898,088.

A cellulose acetate is desirable as a binder for the image-stabilizing layer. In particular, cellulose diacetate having a degree of acetylation of from 40 to 49% is preferred. This image-stabilizing layer is preferably formed between the neutralization layer and the timing layer both described above.

An acid polymer (e.g., a copolymer of methyl vinyl ether and maleic anhydride or a copolymer of methyl vinyl ether and a half ester of maleic anhydride) may be incorporated into the timing layer for the purpose of preventing the cellulose ester from denaturing during long-term storage to result in a prolonged timing duration or of reducing the timing duration.

A white pigment (e.g., titanium dioxide, silicon dioxide, kaolin, zinc dioxide, or barium sulfate) may be further incorporated into the timing layer or the neutralization layer for the purpose of preventing light from penetrating into an inner part of the sheet from its edges (light piping).

A plasticizer may be incorporated into the timing layer or the neutralization layer for the purpose of reducing curling and brittleness. A known compound may be used as the plasticizer.

An interlayer may be formed between the image-receiving layer and the timing layer. For this interlayer, a hydrophilic polymer may be used such as gum arabic, poly(vinyl alcohol), or polyacrylamide.

On the surface of the image-receiving layer, a release layer is preferably formed in order that the spread processing liquid be completely separated from the surface of the image-receiving layer when the photosensitive element and the image-receiving element are stripped apart. Preferred examples of the material of such a release layer include gum arabic, hydroxyethyl cellulose, carboxymethyl cellulose, poly(vinyl alcohol), polyacrylamide, sodium alginate, and the materials described in U.S. Pat. Nos. 3,772,024 and 3,820,999, and British Patent 1,360,653.

Preferred methods for shielding from light are to incorporate a light-shielding agent (e.g., carbon black or an organic black pigment) into the support paper and to coat the back of the support with the light-shielding agent and further with a white pigment (e.g., titanium dioxide, silicon dioxide, kaolin, zinc dioxide, or barium sulfate) for imparting whiteness. A protective layer is preferably formed thereon as the uppermost layer. A matting agent may be incorporated into this protective layer to improve bondability or to impart suitability for writing.

For forming the light-shielding layer and protective layer described above, a gelatin, a cellulose ester, poly(vinyl alcohol), or the like may be used as a binder.

The processing element for use in the present invention contains a developing agent, a silver halide solvent, an alkali, and a toning agent. However, a developing agent and/or a silver halide solvent may be incorporated beforehand in the photosensitive element and/or the image-receiving element according to purposes.

Examples of the developing agent for use in this invention include benzene derivatives in which the benzene nucleus is substituted with at least two hydroxyl and/or amino groups in the ortho and para positions (e.g., hydroquinone, amidol, metol, glycin, p-aminophenol, or pyrogallol) and hydroxylamines and derivatives thereof, in particular, hydroxylamines N-substituted with a primary aliphatic group, a secondary aliphatic group, or an aromatic group and β-hydroxylamines. These compounds are soluble in an aqueous alkali solution. Specific examples thereof include hydroxylamine, N-methylhydroxylamine, N-ethylhydroxylamine, the developing agents given in U.S. Pat. No. 2,857,276, and the N-alkoxyalkyl-substituted hydroxylamines given in U.S. Pat. No. 3,293,034.

Moreover, the hydroxylamine derivatives having a tetrahydrofurfuryl group which are given in JP-A-49-88521 are usable.

Also usable are the aminoreductones given in West German Patent Application (OLS) Nos. 2,009,054, 2,009,055, and 2,009,078 and the heterocyclic aminoreductones given in U.S. Pat. No. 4,128,425.

Furthermore, the tetraalkylreductic acids given in U.S. Pat. No. 3,615,440 are usable.

The developing agent described above may be used in combination with Phenidone or a derivative thereof, p-aminophenol or a derivative thereof, or ascorbic acid as an auxiliary developing agent, and the combination with Phenidone or a derivative thereof is preferred.

At least one of quinones such as those given in JP-A-5-34885 may be incorporated into one or more of the photosensitive element, image-receiving element, and processing element in an amount of from $1\times10^{-6}$ to $5\times10^{-3}$ mol, preferably from $2\times10^{-6}$ to $3\times10^{-3}$ mol, per mol of the silver coated. The incorporation of such a quinone was found to further accelerate image completion.

For the silver halide solvent for use in the present invention, use may be made of ordinary fixing agents (e.g., sodium thiosulfate, sodium thiocyanate, ammonium thiosulfate, and the fixing agents given in U.S. Pat. No. 2,543,181) and combinations of a cyclic imide with a nitrogen-containing base (e.g., a combination of a barbiturate or uracil with ammonia or an amine and a combination such as that described in U.S. Pat. No. 2,857,274). Furthermore, 1,1-bissulfonylalkanes and derivatives thereof are also known, which compounds can be used as the silver halide solvent of the present invention.

The processing composition contains an alkali, which preferably is an alkali metal hydroxide, e.g., sodium hydroxide or potassium hydroxide.

In the case where the processing composition is spread as a thin layer between the photosensitive element and image-receiving element superposed on each other, the processing element preferably contains a polymeric film-forming agent or a thickening agent.

Examples of the polymeric film-forming agent or thickening agent for use in the processing element include cellulose derivatives, e.g., carboxymethyl cellulose, ethyl cellulose, hydroxyethyl cellulose, methyl cellulose, and hydroxypropyl cellulose, vinyl polymers, e.g., poly(vinyl alcohol), acrylic acid polymers, e.g., poly(acrylic acid) and poly(methacrylic acid), and inorganic polymers, e.g., water glass. Particularly preferred of these are hydroxyethyl cellulose and carboxymethyl cellulose. Using a known technique of diffusion transfer photography, these compounds are incorporated into the processing composition at a concentration effective in imparting an appropriate viscosity.

Other additives known in the silver salt diffusion transfer process, e.g., an antifoggant and a stabilizer, may be further incorporated into the processing composition.

The present invention will be explained below in more detail by reference to Examples and Comparative Examples, but the invention should not be construed as being limited thereto.

EXAMPLE 1

1. Production of Image-Receiving Element

The following layers were formed in that order on a polyethylene-laminated paper support to produce an image-receiving element. The numeral in each [ ] indicates coated amount in terms of g/m$^2$.

(1) Neutralization layer

Cellulose acetate (degree of acetylation, 55%) [6.0], methyl vinyl ether-maleic anhydride copolymer [4.0], Uvitex OB (trade name of Ciba-Geigy Ltd.) [0.04], 1-(4 -hexylcarbamoylphenyl)-2,3-dihydroxyimidazole-2-thione [0.25].

(2) Image-stabilizing layer

Cellulose acetate (degree of acetylation, 46%) [4.0], the following compound [2.0].

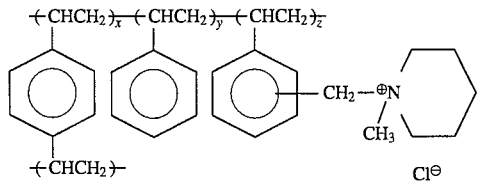

x:y:z = 5:47.5:47.5 (mol %)

(3) Timing layer

Cellulose acetate (degree of acetylation, 55%) [8.0].

(4) Image-receiving layer (thickness: 1.5 μm)

Cellulose acetate (degree of acetylation, 55%) [2.0], palladium sulfide [$7.5\times10^{-4}$], 1-(4-hexylcarbamoylphenyl)-2,3-dihydroimidazole-2-thione [$1.0\times10^{-2}$].

(5) Saponification

The layered structure was saponified from its surface with a liquid obtained by mixing 12 g of sodium hydroxide, 24 g of glycerol, and 280 ml of methanol, and then washed with water.

(6) Release layer

Butyl methacrylate-acrylic acid copolymer (15:85 by mol) [0.1].

(7) Back layers

A light-shielding layer, a white layer, and a protective layer were formed on the back of the support.

(7-1) Light-shielding layer

Carbonblack [4.0], gelatin [8.0].

(7-2) White layer

Titanium dioxide [6.0], gelatin [ 0.7].

(7-3) Protective layer

Poly(methyl methacrylate) particles (average diameter, 0.05 μm) [0.2], gelatin [1.6].

2. Production of Photosensitive Element

The following layers were formed by coating on a support (poly(ethylene terephthalate)) to produce a photosensitive element. The numeral in each [ ] indicates coated amount in terms of g/m$^2$.

(1) Water-absorbing layer (thickness: 2.5 μm)

Gelatin [3.4].

(2) Photosensitive layer (thickness: 1.5 μm)

Emulsion (Em-1) having the properties shown in Table 1 [0.27 in terms of silver amount], emulsion (Em-2) having the properties shown in Table 1 [0.15 in terms of silver amount], 4-hydroxy-6-methyl-1,3,3a,7-tetrazaindene [0.01], the following compounds (A), (B), and (C) [$3.2\times10^{-4}$], [$3.2\times10^{-4}$], and [$1.2\times10^{-4}$], respectively, gelatin [1.6].

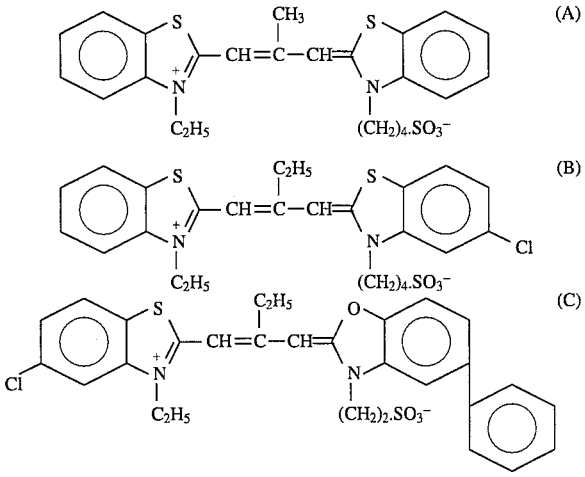

(3) Protective layer (thickness: 0.5 μm)

Gelatin [0.7], poly(methyl methacrylate) particles (average diameter, 4.7 μm) [0.3].

(4) Back layers (4-1) Light-shielding layer

Carbon black [4.0], gelatin [2.0].

(4-2) Protective layer

Gelatin [0.7], poly(methyl methacrylate) particles (average diameter, 0.05 μm) [0.1].

Thus, photosensitive element (1A) was produced. Photosensitive elements (1B) to (1G) were produced in the same manner as the above except that the silver halide emulsions used in the photosensitive layer (2) were replaced by the emulsions shown in Table 1. The same proportion of silver was used.

TABLE 1

| Photo-sensitive element | Kind of emulsion | Amount of internal latent image type AgBrI, mol % (AgI content, mol %) | Total average AgI content, mol % | Diameter of corre-sponding circle, μm | Coeffi-cient of variation, % | Aspect ratio | Remarks |
|---|---|---|---|---|---|---|---|
| 1A | (Em-1) | — | 6.0 | 2.6 | 35 | 4.4 | comparative |
| | (Em-2) | — | 6.5 | 0.8 | 29 | 2.5 | example |
| 1B | (Em-3) | — | 0.2 | 2.6 | 19 | 5.2 | comparative |
| | (Em-4) | — | 0.2 | 0.9 | 20 | 5.0 | example |
| 1C | (Em-5) | 2 (5) | 0.3 | 2.6 | 19 | 5.1 | comparative |
| | (Em-6) | 2 (5) | 0.3 | 0.9 | 20 | 4.8 | example |
| 1D | (Em-7) | 8 (5) | 1.8 | 2.4 | 18 | 4.7 | present |
| | (Em-8) | 5 (10) | 1.9 | 0.8 | 19 | 4.5 | invention |
| 1E | (Em-9) | 5 (7.5) | 2.7 | 2.4 | 18 | 4.6 | present |
| | (Em-10) | 5 (10) | 2.9 | 0.8 | 19 | 4.5 | invention |
| 1F | (Em-11) | 3 (1) | 4.1 | 2.4 | 18 | 3.9 | comparative |
| | (Em-12) | 3 (1) | 4.1 | 0.8 | 19 | 3.6 | example |
| 1G | (Em-13) | 5 (20) | 3.3 | 2.3 | 19 | 4.4 | comparative |
| | (Em-14) | 5 (20) | 3.3 | 0.7 | 20 | 4.2 | example |

Emulsions (Em-1) to (Em-14) used for photosensitive elements (1A) to (1G) were prepared as follows.

Emulsion (Em-1): Each of the following ingredients (a) to (k) was prepared by weighing and mixing the individual substances.

| | |
|---|---|
| (a) $H_2O$ | 1,000 cc |
| KBr | 6.6 g |
| gelatin | 16.7 g |
| (b) $AgNO_3$ | 4.0 g |
| $H_2O$ | up to 30 cc |
| (c) KBr | 2.63 g |
| KI | 0.23 g |
| $H_2O$ | up to 30 cc |
| (d) gelatin | 6.2 g |
| $H_2O$ | 60 cc |
| (e) KBr | 15 g |
| $H_2O$ | up to 50 cc |
| (f) $NH_4NO_3$ (50%) | 20 cc |
| (g) $AgNO_3$ | 46.0 g |
| $H_2O$ | up to 280 cc |
| (h) KBr | 30.3 g |
| KI | 2.70 g |
| $H_2O$ | up to 280 cc |
| (i) $AgNO_3$ | 50.0 g |
| $H_2O$ | up to 300 cc |
| (j) KBr | 32.9 g |
| KI | 2.9 g |
| $H_2O$ | up to 300 cc |
| (k) gelatin | 37 g |

Ingredient (a) was introduced into a tank, and heated to 62° C. with stirring to dissolve the soluble substances. After the pH was adjusted to 6.5, ingredients (b) and (c) were added simultaneously over a period of 1 minute. Ingredients (d), (e), and (f) were then added. The pH was raised to 8.8, and this mixture was then physically ripened for 75 minutes. After the physical ripening, the pH was lowered to 6.5, and ingredients (g) and (h) were added simultaneously over a period of 30 minutes. Ingredients (i) and (j) were then added simultaneously over a period of 20 minutes. Thereafter, the resulting mixture was cooled to 40° C., and a polymeric coagulant and an acid were added to conduct desalting three times at a lowered pH. Ingredient (k) was then added, and $H_2O$ was also added in such an amount that the whole mixture amounted to 880 g. The pH of this mixture was adjusted to 6.2 and the mixture was agitated for redispersion. The resulting mixture was heated to 62° C., and then subjected to a combination of sulfur sensitization and gold sensitization using sodium thiosulfate, chloroauric acid, and potassium thiocyanate, which combination was the optimum chemical sensitization.

Emulsion (Em-2):

This emulsion was prepared in the same manner as for emulsion (Em-1), except that ingredients (b), (c), (g), (h), and (j) were changed to the following ones and that the grain formation temperature was changed to 50° C.

| | |
|---|---|
| (b) $AgNO_3$ | 8.0 g |
| $H_2O$ | up to 30 cc |
| (c) KBr | 5.24 g |
| KI | 0.51 g |
| $H_2O$ | up to 30 cc |
| (g) $AgNO_3$ | 42.0 g |
| $H_2O$ | up to 280 cc |
| (h) KBr | 27.5 g |
| KI | 2.67 g |
| $H_2O$ | up to 280 cc |
| (j) KBr | 32.7 g |
| KI | 3.2 g |
| $H_2O$ | up to 300 cc |

In order to prepare emulsions (Em-3) to (Em-10), seed-crystal emulsions (Em-α) and (Em-β) and fine grain emulsion (Em-γ) were prepared.

Seed-Crystal Emulsion (Em-α): Each of the following ingredients (a) to (i) was prepared by weighing and mixing the individual substances.

| | |
|---|---|
| (a) $H_2O$ | 990 cc |
| KBr | 4.5 g |
| gelatin | 6.9 g |
| (b) $AgNO_3$ | 7.0 g |
| $H_2O$ | up to 30 cc |
| (c) KBr | 5.2 g |
| $H_2O$ | up to 30 cc |
| (d) gelatin | 25.6 g |
| $H_2O$ | 300 cc |
| (e) $AgNO_3$ | 5.0 g |
| $H_2O$ | up to 15 cc |
| (f) $NH_4NO_3$ (50%) | 32 cc |
| (g) $AgNO_3$ | 70.0 g |
| $H_2O$ | up to 590 cc |
| (h) KBr | 50.0 g |
| $H_2O$ | up to 590 cc |
| (i) gelatin | 35 g |

Ingredient (a) was introduced into a tank, and heated at 40° C. to dissolve the soluble substances. After the pH was adjusted to 6.5, ingredients (b) and (c) were added simultaneously over a period of 1 minute. Ingredient (d) was then added, and this mixture was physically ripened for 8 minutes. The resulting mixture was heated to 60° C., and ingredient (e) was added over a period of 1 minute. Ingredient (f) was then added, and this mixture was physically ripened for 40 minutes at an elevated pH of 8.8. Thereafter, the pH was lowered to 6.5, and ingredient (g) was added over a period of 45 minutes, during which addition the pAg was kept at 8.5 by adding ingredient (h). After completion of the addition, the mixture was cooled to 35° C., and a polymeric coagulant and an acid were added to conduct desalting three times at a lowered pH. Ingredient (i) was then added, and $H_2O$ was also added in such an amount that the whole mixture amounted to 630 g. The pH of this mixture was adjusted to 6.5 and the mixture was agitated for redispersion.

The seed-crystal emulsion grains thus obtained were AgBr grains having a diameter, in terms of the diameter of the circle corresponding to the projected area, of 0.9 μm (coefficient of variation, 16%) and an aspect ratio of 4.8.

Seed-Crystal Emulsion (Em-β):

This emulsion was prepared in the same manner as for seed-crystal emulsion (Em-α), except that ingredients (e) to (i) were added at 50° C. and that during the addition of ingredient (g), the pAg was kept at 8.2 by adding ingredient (h).

The seed-crystal emulsion grains thus obtained were AgBr grains having a diameter, in terms of the diameter of the circle corresponding to the projected area, of 0.5 μm (coefficient of variation, 17%) and an aspect ratio of 4.6.

Fine Grain Emulsion (Em-γ): Each of the following ingredients (a) to (e) was prepared by weighing and mixing the individual substances.

| | |
|---|---|
| (a) $H_2O$ | 1,100 cc |
| KBr | 0.8 g |
| gelatin | 40 g |
| (b) $AgNO_3$ | 100 g |
| $H_2O$ | up to 500 cc |
| (c) KBr | 37 g |
| $H_2O$ | up to 260 cc |

-continued

| | |
|---|---|
| (d) KBr | 42 g |
| $H_2O$ | up to 300 cc |
| (e) gelatin | 45 g |

Ingredient (a) was introduced into a tank, and heated to 40° C. with stirring to dissolve the soluble substances. Ingredients (b) and (c) were added simultaneously over a period of 10 minutes, during which addition the pAg was kept at 8.1 with ingredient (d). After completion of the addition, the mixture was cooled to 35° C. and a polymeric coagulant and an acid were added to conduct desalting three times at a lowered pH. Ingredient (e) was then added, and $H_2O$ was also added in such an amount that the whole mixture amounted to 1,000 g. The pH of this mixture was adjusted to 6.2 and the mixture was agitated for redispersion.

The fine grain emulsion grains thus obtained were cubic AgBr grains having an average side length of 0.05 μm.

Emulsions (Em-3) to (Em-12) were prepared as follows.

Emulsion (Em-3): Each of the following ingredients (a) to (i) was prepared by weighing and mixing the individual substances.

| | |
|---|---|
| (a) $H_2O$ | 440 cc |
| KBr | 1.0 g |
| gelatin | 12 g |
| seed-crystal emulsion (Em-α) | 38 g |
| (b) $AgNO_3$ | 26 g |
| $H_2O$ | up to 200 cc |
| (c) KBr | 22.6 g |
| $H_2O$ | up to 220 cc |
| (d) KI | 0.13 g |
| $H_2O$ | up to 80 cc |
| (e) gelatin | 7.8 g |
| $H_2O$ | 60 cc |
| (f) KSCN (1N) | 12 cc |
| (g) $AgNO_3$ | 32.5 g |
| $H_2O$ | up to 160 cc |
| (h) KBr | 27.7 g |
| $H_2O$ | up to 180 cc |
| (i) gelatin | 26 g |

Ingredient (a) was introduced into a tank, and heated to 75° C. with stirring to dissolve the soluble substances. Ingredient (b) was added over a period of 80 minutes, during which addition the pAg was kept at 8.0 by adding ingredient (c). Thereafter, the mixture was cooled to 50° C., and ingredient (d) was added. The resulting mixture was heated to 75° C., and ingredients (e) and (f) were added. Ingredient (g) was then added over a period of 30 minutes, during which addition also the pAg was kept at 8.0 by adding ingredient (h). After completion of the addition of ingredients (g) and (h), the mixture was cooled to 35° C., and a polymeric coagulant and an acid were added to conduct desalting three times at a lowered pH. Ingredient (i) was then added, and $H_2O$ was also added in such an amount that the whole mixture amounted to 550 g. The pH of this mixture was adjusted to 6.2 and the mixture was agitated for redispersion. Thereafter, the resulting mixture was heated to 62° C., and the following compounds (1) to (7) were added thereto to conduct optimal chemical sensitization.

$Na_2S_2O_3.5H_2O$ (1)

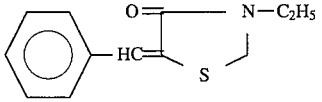

(2)

-continued

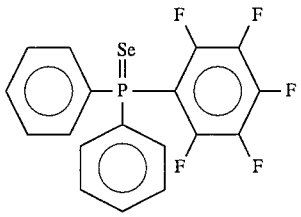

(3)

$HAuCl_4.4H_2O$ (4)

KSCN (5)

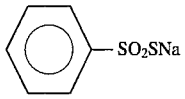

(6)

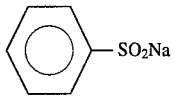

(7)

Emulsion (Em-4):

This emulsion was prepared in the same manner as for emulsion (Em-3), except that ingredient (a) was changed to following one.

| | |
|---|---|
| (a) $H_2O$ | 440 cc |
| KBr | 1.0 g |
| gelatin | 12 g |
| seed-crystal emulsion (Em-β) | 73 g |

Emulsion (Em-5):

This emulsion was prepared in the same manner as for emulsion (Em-3), except that after the chemical sensitization, the following ingredients (k) and (l) were added to conduct Ostwald ripening at 62° C. for 40 minutes. As a result of the Ostwald ripening, the grains of the fine grain emulsion disappeared and deposited on the surface (mainly corners and edges) of the grains of emulsion (Em-3).

| | |
|---|---|
| (k) fine grain emulsion (Em-γ) | 36 g |
| (l) KI (1%) | 23 cc |

Emulsion (Em-6):

This emulsion was prepared in the same manner as for emulsion (Em-4), except that after the chemical sensitization, the following ingredients (k) and (l) were added to conduct Ostwald ripening at 62° C. for 40 minutes.

| | |
|---|---|
| (k) fine grain emulsion (Em-γ) | 40 g |
| (l) KI (1%) | 34 cc |

Emulsion (Em-7):

This emulsion was prepared in the same manner as for emulsion (Em-3), except that ingredients (d) and (h) were changed to the following ones.

| | |
|---|---|
| (d) KI | 0.62 g |
| $H_2O$ | up to 80 cc |
| (h) KBr | 27.5 g |
| KI | 0.37 g |
| $H_2O$ | up to 180 cc |

After the chemical sensitization, the following ingredients (k) and (l) were added to conduct Ostwald ripening at 62° C. for 40 minutes.

| | |
|---|---|
| (k) fine grain emulsion (Em-γ) | 58 g |
| (l) KI (1%) | 25 cc |

Emulsion (Em-8):

This emulsion was prepared in the same manner as for emulsion (Em-4), except that ingredients (d) and (h) were changed to the following ones.

| | |
|---|---|
| (d) KI | 0.62 g |
| $H_2O$ | up to 80 cc |
| (h) KBr | 27.5 g |
| KI | 0.37 g |
| $H_2O$ | up to 180 cc |

After the chemical sensitization, the following ingredients (k) and (l) were added to conduct Ostwald ripening at 62° C. for 40 minutes.

| | |
|---|---|
| (k) fine grain emulsion (Em-γ) | 40 g |
| (l) KI (1%) | 34 cc |

Emulsion (Em-9):

This emulsion was prepared in the same manner as for emulsion (Em-3), except that ingredients (d) and (h) were changed to the following ones.

| | |
|---|---|
| (d) KI | 0.93 g |
| $H_2O$ | up to 80 cc |
| (h) KBr | 27.3 g |
| KI | 0.74 g |
| $H_2O$ | up to 180 cc |

After the chemical sensitization, the following ingredients (k) and (l) were added to conduct Ostwald ripening at 62° C. for 40 minutes.

| | |
|---|---|
| (k) fine grain emulsion (Em-γ) | 36 g |
| (l) KI (1%) | 23 cc |

Emulsion (Em-10):

This emulsion was prepared in the same manner as for emulsion (Em-4), except that ingredients (d) and (h) were changed to the following ones.

| | |
|---|---|
| (d) KI | 0.93 g |
| $H_2O$ | up to 80 cc |
| (h) KBr | 27.3 g |
| KI | 0.74 g |
| $H_2O$ | up to 180 cc |

After the chemical sensitization, the following ingredients (k) and (l) were added to conduct Ostwald ripening at 62° C. for 40 minutes.

| | |
|---|---|
| (k) fine grain emulsion (Em-γ) | 40 g |
| (l) KI (1%) | 34 cc |

Emulsion (Em-11):

This emulsion was prepared in the same manner as for emulsion (Em-3), except that ingredients (d) and (h) were changed to the following ones.

| | |
|---|---|
| (d) KI | 0.93 g |

-continued

| | |
|---|---|
| $H_2O$ | up to 80 cc |
| (h) KBr | 26.4 g |
| KI | 2.0 g |
| $H_2O$ | up to 180 cc |

After the chemical sensitization, the following ingredients (k) and (l) were added to cobduct Ostwald ripening at 62° C. for 40 minutes.

| | |
|---|---|
| (k) fine grain emulsion (Em-γ) | 22 g |
| (l) KI (1%) | 1.9 cc |

Emulsion (Em-12):

This emulsion was prepared in the same manner as for emulsion (Em-4), except that ingredients (d) and (h) were changed to the following ones.

| | |
|---|---|
| (d) KI | 0.93 g |
| $H_2O$ | up to 80 cc |
| (h) KBr | 26.4 g |
| KI | 2.0 g |
| $H_2O$ | up to 180 cc |

After the chemical sensitization, the following ingredients (k) and (l) were added to conduct Ostwald ripening at 62° C. for 40 minutes.

| | |
|---|---|
| (k) fine grain emulsion (Em-γ) | 24 g |
| (l) KI (1%) | 2.0 cc |

Emulsion (Em-13):

This emulsion was prepared in the same manner as for emulsion (Em-9), except that after the chemical sensitization, the following ingredients (k) and (l) were added to conduct Ostwald ripening at 62° C. for 40 minutes.

| | |
|---|---|
| (k) fine grain emulsion (Em-γ) | 36 g |
| (l) KI (1%) | 61 cc |

Emulsion (Em-14):

This emulsion was prepared in the same manner as for emulsion (Em-10), except that after the chemical sensitization, the following ingredients (k) and (l) were added and Ostwald ripening was conducted at 62° C. for 40 minutes.

| | |
|---|---|
| (k) fine grain emulsion (Em-γ) | 40 g |
| (l) KI (1%) | 68 cc |

3. Preparation of Processing Liquid and Production of Pod

A processing liquid was prepared according to the formulation given in Table 2. Since the processing liquid is oxidized by air, it was prepared in a nitrogen stream. The processing liquid prepared was packed into rupturable containers (pods) in an amount of 0.7 g per container, thereby giving a processing element.

TABLE 2

| | |
|---|---|
| Titanium dioxide | 5 g |
| Potassium hydroxide | 280 g |
| Uracil | 90 g |
| Sodium thiosulfate (anhydrous) | 1.0 g |
| Tetrahydropyrimidinethione | 0.2 g |

TABLE 2-continued

| | |
|---|---|
| 2,4-Dimercaptopyrimidine | 0.2 g |
| Sodium 3-(5-mercaptotetrazolyl)benzenesulfonate | 0.2 g |
| Potassium iodide | 0.3 g |
| Zinc nitrate.$9H_2O$ | 40 g |
| Triethanolamine | 6 g |
| Hydroxyethyl cellulose | 45 g |
| N,N-Bis(methoxyethyl)hydroxylamine (17% aqueous solution) | 250 g |
| 4-Methyl-4-hydroxymethyl-1-phenyl-3-pyrazolidinone | 3.0 g |
| $H_2O$ | 1,266 ml |

4. Spreading Processing

Photosensitive elements (1A) to (1G) were subjected to gradient exposure through a continuous wedge under conditions of 16 lux (4,800° K.) and 1/100 sec. Each resulting photosensitive element was processed using the above-described image-receiving element and processing element at 15° C. and 25° C. in such a manner that the thickness (D) of the spread liquid of the processing element was 38 μm. With respect to the samples thus treated at 15° C., the image-receiving element and photosensitive element were stripped apart after 30 seconds. With respect to the samples treated at 25° C., the two elements were stripped apart after 15 seconds. The resulting image-receiving elements were examined for optical density. Their maximum densities ($D_{max}$) and sensitivities ($S_{0.6}$) were evaluated.

The value of sensitivity ($S_{0.6}$) for each sample indicates the relative value of the logarithm of the reverse number of the exposure at a density of 0.6. Larger values of $D_{max}$ and $S_{0.6}$ are preferred. The results obtained are shown in Table 3.

TABLE 3

| Photosensitive | 15° C. | | 25° C. | | |
|---|---|---|---|---|---|
| element | $D_{max}$ | $S_{0.6}$ | $D_{max}$ | $S_{0.6}$ | Remarks |
| 1A | 1.38 | 66 | 1.40 | 100 | comparative example |
| 1B | 1.70 | 18 | 1.68 | 25 | comparative example |
| 1C | 1.72 | 41 | 1.72 | 48 | comparative example |
| 1D | 1.87 | 200 | 1.85 | 209 | present invention |
| 1E | 1.85 | 240 | 1.84 | 245 | present invention |
| 1F | 1.72 | 65 | 1.70 | 71 | comparative example |
| 1G | 1.61 | 105 | 1.60 | 126 | comparative example |

As shown in Table 3, Comparative Examples (1A) and (1G), which had a high total average AgI content, showed poor photographic performance with a low $D_{max}$ value. Comparative Examples (1B) and (1C) showed poor photographic performance with a low $S_{0.6}$ value, although their $D_{max}$ values were high. In contrast, samples (1D) and (1E) according to the present invention showed satisfactory photographic performance with high $D_{max}$ and $S_{0.6}$ values, as compared with Comparative Examples (1A) to (1C), (1F), and (1G).

EXAMPLE 2

Image-receiving elements were prepared in the same manner as in Example 1, except that the thickness of the image-receiving layer (4) was changed. Photosensitive elements were prepared in the same manner as for photosensitive element (1E) in Example 1, except that the thicknesses of the water-absorbing layer (1) and photosensitive layer (2) were changed. Further, processing elements were prepared in the same manner as in Example 1, except that the following compound (a) or (b) was added in an amount of 0.7 mg or 1.0 mg, respectively, before packing into pods. These elements were used in the combinations shown in Table 4 to produce samples" (2A) to (2R), which samples were then exposed at 25° C. and subjected to spreading processing in the same manner as in Example 1. The results obtained are summarized in Table 5.

TABLE 4

| | Image-receiving element | Photosensitive element | | | | Processing element | | |
|---|---|---|---|---|---|---|---|---|
| Sample | Thickness of image-receiving layer, Tr | Thickness of water-absorbing layer | Thickness of photo-sensitive layer | Thick-ness of protective layer | Thickness, Ts | Additive | Thick-ness of spread liquid D | Remarks |
| 2A | 1.5 | 2.5 | 1.5 | 0.5 | 4.5 | — | 20 | comparative example |
| 2B | 1.5 | 2.5 | 1.5 | 0.5 | 4.5 | — | 36 | present invention |
| 2C | 1.5 | 2.5 | 1.5 | 0.5 | 4.5 | — | 44 | present invention |
| 2D | 1.5 | 2.5 | 1.5 | 0.5 | 4.5 | — | 60 | comparative example |
| 2E | 1.5 | 2.5 | 1.5 | 0.5 | 4.5 | (a) | 36 | present invention |
| 2F | 1.5 | 2.5 | 1.5 | 0.5 | 4.5 | (b) | 36 | present invention |
| 2G | 2.0 | 2.5 | 2.5 | 0.5 | 5.5 | — | 42 | present invention |
| 2H | 2.0 | 2.5 | 2.5 | 0.5 | 5.5 | (a) | 42 | present invention |

TABLE 4-continued

| Sample | Image-receiving element: Thickness of image-receiving layer, Tr | Photosensitive element: Thickness of water-absorbing layer | Photosensitive element: Thickness of photo-sensitive layer | Photosensitive element: Thick-ness of protective layer | Photosensitive element: Thickness, Ts | Processing element: Additive | Processing element: Thick-ness of spread liquid D | Remarks |
|---|---|---|---|---|---|---|---|---|
| 2I | 1.5 | 3.5 | 2.0 | 0.5 | 6.0 | — | 42 | present invention |
| 2J | 1.5 | 3.5 | 2.0 | 0.5 | 6.0 | (b) | 42 | present invention |
| 2K | 1.5 | 3.5 | 1.5 | 0.5 | 5.5 | (a) | 38 | present invention |
| 2L | 1.5 | 3.5 | 1.5 | 0.5 | 5.5 | (b) | 38 | present invention |
| 2M | 2.5 | 2.5 | 2.5 | 0.5 | 5.5 | — | 22 | comparative example |
| 2N | 2.5 | 2.5 | 2.5 | 0.5 | 5.5 | — | 38 | present invention |
| 2O | 2.5 | 2.5 | 2.5 | 0.5 | 5.5 | — | 70 | comparative example |
| 2P | 2.5 | 2.5 | 2.5 | 0.5 | 5.5 | — | 80 | comparative invention |
| 2Q | 2.5 | 2.5 | 2.5 | 0.5 | 5.5 | (a) | 40 | present invention |
| 2R | 2.5 | 2.5 | 2.5 | 0.5 | 5.5 | (b) | 40 | present invention |

*All the thickness values in the table are given in terms of μm.

(a)

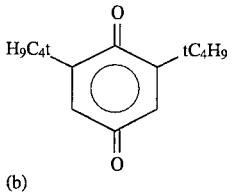

(b)

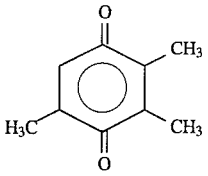

TABLE 5

| Photosensitive element | 10 sec. $D_{max}$ | 15 sec. $D_{max}$ | 30 sec. $D_{max}$ | Remarks |
|---|---|---|---|---|
| 2A* | — | — | — | comparative example |
| 2B | 1.36 | 1.83 | 1.94 | present invention |
| 2C | 1.33 | 1.81 | 1.93 | " |
| 2D | 1.04 | 1.72 | 1.89 | comparative example |
| 2E | 1.50 | 1.85 | 1.93 | present invention |
| 2F | 1.45 | 1.83 | 1.93 | " |
| 2G | 1.32 | 1.81 | 1.92 | " |
| 2H | 1.48 | 1.82 | 1.92 | " |
| 2I | 1.35 | 1.80 | 1.90 | " |
| 2J | 1.45 | 1.82 | 1.90 | " |
| 2K | 1.42 | 1.83 | 1.92 | " |
| 2L | 1.40 | 1.82 | 1.93 | " |
| 2M* | — | — | — | comparative example |
| 2N | 1.33 | 1.80 | 1.92 | present invention |
| 2O | 0.98 | 1.68 | 1.87 | comparative example |
| 2P | 0.85 | 1.57 | 1.80 | " |
| 2Q | 1.46 | 1.82 | 1.91 | present invention |
| 2R | 1.43 | 1.81 | 1.91 | " |

*2A and 2M had uneveness of density probably because of an insufficient processing liquid amount and, hence, accurate density measurement was impossible.

As Table 5 shows, samples (2B), (2C), (2E) to (2L), (2N), (2Q), and (2R), which each was a combination in which the thickness of the spread processing liquid was within the range specified in the present invention, showed more rapid image completion than Comparative Examples (2A), (2D), (2M), (20), and (2P).

According to the present invention, a film unit which is capable of rapidly completing a transferred image and has high sensitivity can be obtained. Furthermore, a satisfactory transferred image can be obtained even at low temperatures.

While the invention has been described in detail and with reference to specific embodiments thereof, it will be apparent to one skilled in the art that various changes and modifications can be made therein without departing from the spirit and scope thereof.

What is claimed is:

1. A process for image formation by silver salt diffusion transfer which comprises developing an imagewise exposed photosensitive element containing a photosensitive silver halide emulsion layer with an alkaline processing element containing a silver halide solvent to thereby convert at least part of the silver halide present in the unexposed area of the emulsion layer into a transferable silver complex and then transferring at least part of the silver complex to an image-receiving element containing an image-receiving layer containing silver-precipitating nuclei to thereby form an image on the image-receiving element, said silver halide emulsion contained in the silver halide emulsion layer in the photosensitive element being a tabular grain emulsion which is obtained by chemically sensitizing tabular silver halide grains and depositing a silver iodobromide having a silver iodide content of from 2 to 15 mol % on the surface of the resulting grains in an amount of from 3 to 20 mol % and which has a total average silver iodide content of from 0.5 to 3.5 mol % and an average aspect ratio of from 2 to 20, and being a mixture of two or more kinds of emulsions each containing monodisperse tabular grains having a projected area corresponding circle diameter of from 0.5 to 10 μm, and said photosensitive element, image-receiving element, and processing element satisfying the relationship shown by the following equation (1):

$$(Ts+Tr)\times 5 \leqq D < (Ts+Tr)\times 5+20\ \mu m \quad (1)$$

wherein Ts (μm) is the thickness of the photosensitive element on the silver halide emulsion layer side, excluding a support, Tr (μm) is the thickness of the silver-precipitating-nuclei-containing image-receiving layer in the image-receiving element, and D (μm) is the thickness of the spread liquid of the processing element.

2. The process for image formation by silver salt diffusion transfer as claimed in claim 1, wherein said total average silver iodide content is from 1.0 to 3.5 mol %.

3. The process for image formation by silver salt diffusion transfer as claimed in claim 2, wherein said total average silver iodide content is from 1.5 to 3.0 mol %.

4. The process for image formation by silver salt diffusion transfer as claimed in claim 1, wherein the amount of the silver iodobromide deposited is from 3 to 15 mol % based on the amount of the host grains.

5. The process for image formation by silver salt diffusion transfer as claimed in claim 1, wherein the silver iodide content of the silver iodobromide deposited on the grain surface is from 3 to 10 mol %.

6. The process for image formation by silver salt diffusion transfer as claimed in claim 1, wherein said average aspect ratio is from 2 to 15.

7. The process for image formation by silver salt diffusion transfer as claimed in claim 6, wherein said average aspect ratio is from 3 to 10.

8. The process for image formation by silver salt diffusion transfer as claimed in claim 1, wherein said Ts is 0.5 to 8.0 μm.

9. The process for image formation by silver salt diffusion transfer as claimed in claim 8, wherein said Ts is 1.0 to 6.0 μm.

10. The process for image formation by silver salt diffusion transfer as claimed in claim 1, wherein said Tr is 0.2 to 6.0 μm.

11. The process for image formation by silver salt diffusion transfer as claimed in claim 10, wherein said Tr is 0.5 to 4.0 μm.

* * * * *